US010301864B2

(12) United States Patent
Yasaka et al.

(10) Patent No.: US 10,301,864 B2
(45) Date of Patent: May 28, 2019

(54) DOOR DRIVING SYSTEM AND REFRIGERATOR INCLUDING THE SAME

(71) Applicant: SAMSUNG ELECTRONICS CO., LTD., Suwon-si, Gyeonggi-do (KR)

(72) Inventors: Yoshio Yasaka, Yokohama (JP); Kentaro Kan, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 42 days.

(21) Appl. No.: 15/455,788

(22) Filed: Mar. 10, 2017

(65) Prior Publication Data

US 2017/0284144 A1 Oct. 5, 2017

(30) Foreign Application Priority Data

Mar. 30, 2016 (JP) ..... 2016-068812
Sep. 13, 2016 (KR) ..... 10-2016-0118113

(51) Int. Cl.
*E05F 15/614* (2015.01)
*E06B 3/36* (2006.01)
*F25D 23/02* (2006.01)

(52) U.S. Cl.
CPC ..... *E05F 15/614* (2015.01); *E06B 3/36* (2013.01); *F25D 23/028* (2013.01); (Continued)

(58) Field of Classification Search
USPC ..... 49/277
See application file for complete search history.

(56) References Cited

U.S. PATENT DOCUMENTS 5,761,559 A * 6/1998 Yamazaki ..... G03B 17/30 396/513
8,234,818 B2 * 8/2012 Hecht ..... E05F 15/73 49/31

(Continued)

FOREIGN PATENT DOCUMENTS

GB 872577 7/1961
JP 3-295991 12/1991

(Continued)

OTHER PUBLICATIONS

International Search Report dated Jul. 12, 2017, in corresponding International Patent Application No. PCT/KR2017/003018.

(Continued)

*Primary Examiner* — Catherine A Kelly
(74) *Attorney, Agent, or Firm* — Staas & Hasley LLP

(57) ABSTRACT

Disclosed herein are a refrigerator includes a housing, a door rotatably installed at the housing using a hinge, and a door driving system to open or close the housing using the door. The door driving system includes a motor to output power to open or close the door, a sun gear linked with the motor, a planetary gear linked with the sun gear, and provided to be rotated about an axis thereof and to revolve, an internal gear linked with the planetary gear and configured to transfer power generated by the motor to the hinge, and a carrier configured to be rotated linked with the planetary gear and selectively support the planetary gear to be rotated about the axis thereof. When the planetary gear is rotated about the axis thereof, the power of the motor is transferred to the internal gear and thus the door is automatically opened or closed.

17 Claims, 9 Drawing Sheets

(52) U.S. Cl.
CPC ..... *E05Y 2201/426* (2013.01); *E05Y 2201/43* (2013.01); *E05Y 2201/626* (2013.01); *E05Y 2201/72* (2013.01); *E05Y 2800/242* (2013.01); *E05Y 2900/31* (2013.01); *F25D 2323/024* (2013.01)

(56) References Cited

U.S. PATENT DOCUMENTS

| | | | | |
|---|---|---|---|---|
| 8,448,383 | B2 * | 5/2013 | Bode | E05F 15/63 49/334 |
| 9,938,760 | B2 * | 4/2018 | Makino | E05F 15/643 |
| 2010/0018122 | A1 * | 1/2010 | Hecht | E05F 15/627 49/31 |
| 2017/0097185 | A1 * | 4/2017 | Yasaka | E05F 15/614 |
| 2017/0261252 | A1 * | 9/2017 | Son | F25D 23/028 |

FOREIGN PATENT DOCUMENTS

| | | |
|---|---|---|
| JP | 8-23249 | 3/1996 |
| JP | 2002-257466 | 9/2002 |
| JP | 3442276 | 9/2003 |
| JP | 2005-326044 | 11/2005 |
| JP | 2015-86524 | 5/2015 |
| JP | 2016-11797 | 1/2016 |

OTHER PUBLICATIONS

European Office Action dated Nov. 15, 2018 in European Patent Application No. 17775717.6.

* cited by examiner

DOOR DRIVING SYSTEM AND REFRIGERATOR INCLUDING THE SAME

CROSS-REFERENCE TO RELATED APPLICATIONS

This application claims the benefit of Korean Patent Application No. 10-2016-0118113, filed on Sep. 13, 2016 in the Korean Intellectual Property Office and Japanese Patent Application No. 2016-068812, filed on Mar. 30, 2016 in Japanese Intellectual Property Office the disclosure of which is incorporated herein by reference.

BACKGROUND

1. Field

Embodiments of the present disclosure relate to a door driving system to be used to open or close a door of a refrigerator, and a refrigerator including the same.

2. Description of the Related Art

As disclosed in Japanese patent application publication No. 2002-257466, there is a device for automatically opening a door of a refrigerator, in which when a switch is manipulated in a state in which the door is closed, a cam installed at a housing is rotated by power generated by a motor, protrudes to a side of the door, and thus pushes the door, thereby automatically opening the door.

Furthermore, there may be a door driving system in which a plurality of gears are interposed between an output shaft of a motor and a hinge of a door to automatically open or close the door, and are rotated by power generated by the motor to transmit the power of the motor to the door, thereby opening or closing the door.

However, in the above structure, if the plurality of gears are engaged with each other when the door which is at a closed position is to be opened, a torque needed to overcome a magnetic force between the door and a housing increases and thus the size of the motor should be increased accordingly.

SUMMARY

Therefore, it is an aspect of the present disclosure to provide a door driving system for use in a refrigerator, which is capable of reducing a torque needed to remove a magnetic force between a door and a housing.

Additional aspects of the disclosure will be set forth in part in the description which follows and, in part, will be obvious from the description, or may be learned by practice of the disclosure.

In accordance with one aspect of the present disclosure, a refrigerator includes a housing, a door rotatably installed at the housing using a hinge, and a door driving system to open or close the housing using the door.

And the door driving system includes a motor to output power to open or close the door, a sun gear linked with the motor, a planetary gear linked with the sun gear, and provided to be rotated about an axis thereof and to revolve, an internal gear linked with the planetary gear and configured to transfer power generated by the motor to the hinge, and a carrier configured to be rotated linked with the planetary gear and selectively support the planetary gear to be rotated about the axis thereof, and when the planetary gear is rotated about the axis thereof, the power of the motor is transferred to the internal gear and thus the door is automatically opened or closed.

And when the planetary gear revolves, the power of the motor is not transferred to the internal gear.

And the internal gear comprises internal teeth to be engaged with teeth of the planetary gear, and is rotated by the internal teeth when the planetary gear is rotated about the axis thereof by the power of the motor.

And the carrier is provided to be engaged with the teeth of the planetary gear, and the planetary gear revolves when the carrier is rotated.

And the refrigerator further includes a locking device to selectively limit rotation of the carrier, and the planetary gear is rotated about the axis thereof when the carrier is in a locked state, and revolves linked with the carrier when the carrier is an unlocked state, and the rotation of the carrier is limited by the locking device in the locked state, and the carrier is rotatable by the locking device in the unlocked state.

And the carrier comprises a dented part formed in an outer circumference surface thereof, and the locking device includes a locking member to be selectively wedged into the dented part as the carrier is rotated, and a pressurizing member to pressurize the locking member against an outer surface of the carrier.

And the planetary gear transfers the power of the motor to the internal gear in the locked state, and transfers the power of the motor to the carrier in the unlocked state.

And when the hinge generates a turning force and the internal gear is rotated by the turning force, the planetary gear revolves and thus the turning force is not transferred to the motor.

And the refrigerator further includes an auxiliary device to receive the power of the motor, generate auxiliary power, and move the door, which is at a closed position, in an opening direction.

And the auxiliary device includes a slide member slidably installed on the door; an auxiliary pressurizing member coupled to one end part of the slide member and rotated linked with sliding of the slide member to pressurize the door, and a power conversion device coupled to another end part of the slide member and configured to slide the slide member as the carrier is rotated.

And the carrier comprises a rotation part arranged above the carrier and rotated together with the carrier, and the power conversion device comprises a hook part to be selectively engaged with the rotation part according to a direction of rotation of the carrier.

In accordance with one aspect of the present disclosure, a refrigerator includes a housing, a door rotatably installed at the housing using a hinge, a motor provided to open or close the housing using the door, an output power to open or close the door, and a planetary gear unit to transfer the power of the motor to the hinge of the door.

The planetary gear unit transfers the power of the motor to the hinge and does not transfer a turning force generated by the hinge to the motor.

And the planetary gear unit includes a sun gear to be rotated linked with the motor, a plurality of planetary gears having teeth to be engaged with teeth of the sun gear, an internal gear having internal teeth to be engaged with the teeth of the plurality of planetary gears, and rotated linked with the door, and a carrier to support the plurality of planetary gears to be rotatable on axes thereof.

The power of the motor is transferred to the hinge via the sun gear, the plurality of planetary gears, and the internal gear, and the turning force generated by the hinge is transferred to the carrier via the internal gear and the plurality of planetary gears.

And the refrigerator further includes a locking device to be switched between a locked state and an unlocked state, wherein the carrier is fixed in the locked state and is rotatable in the unlocked state.

The carrier comprises a dented part formed in an outer circumference surface thereof.

The locking device includes a locking member to be moved between a locked position and a withdrawn position, the locking member is wedged into the dented part at the locked position in the locked state and is separated from the dented part at the withdrawn position in the unlocked state, and a pressurizing member to pressurize the locking member toward the locked position from the withdrawn position.

And the locking member is provided to overcome pressure applied by the pressurizing member and to be moved from the locked position to the withdrawn position when the turning force generated by the hinge applied to the carrier is greater than or equal to a predetermined level in a state in which the locking member is in the locked position.

And the planetary gear unit is provided to rotate the carrier in the unlocked state by sequentially transferring the power of the motor to the sun gear, the plurality of planetary gears, and the carrier, and to transfer the power of the motor to the hinge in the locked state by sequentially transferring the power of the motor to the sun gear, the plurality of planetary gears, and the internal gear.

And when the turning force is generated by the hinge, the planetary gear unit is provided to sequentially transfer the turning force to the internal gear, the plurality of planetary gears, and the carrier and not to transfer the turning force to the sun gear.

And refrigerator further includes an auxiliary device to generate auxiliary power for moving the door, which is in a closed state, to be opened.

The auxiliary power is generated by the auxiliary device before the power of the motor is transferred to the hinge via the planetary gear unit.

And in the unlocked state, the power of the motor is transferred to the auxiliary device via the carrier, the door which is at a closed position is moved in an opening direction by the auxiliary power generated by the auxiliary device, and then the locking device is switched from the unlocked state to the locked state, thereby transferring the power to the hinge through the internal gear.

In accordance with one aspect of the present disclosure, a door driving system includes a motor to generate power for opening or closing a door rotatably installed at a housing, a power transfer device to transfer the power of the motor to a hinge of the door, and an auxiliary device to generate auxiliary power for moving the door, which is in a closed state, to be opened.

The auxiliary power is generated by the auxiliary device before the power of the motor is transferred to the hinge via the power transfer device.

And the door driving system further includes a clutch device to switch from one of a power transfer state and a non-power transfer state to the other.

The power of the motor is transferred to the hinge in the power transfer state, and is not transferred to the hinge in the non-power transfer state.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a door driving system for use in a refrigerator in accordance with an embodiment of the present disclosure will be described with reference to the accompanying drawings.

Figure 1:
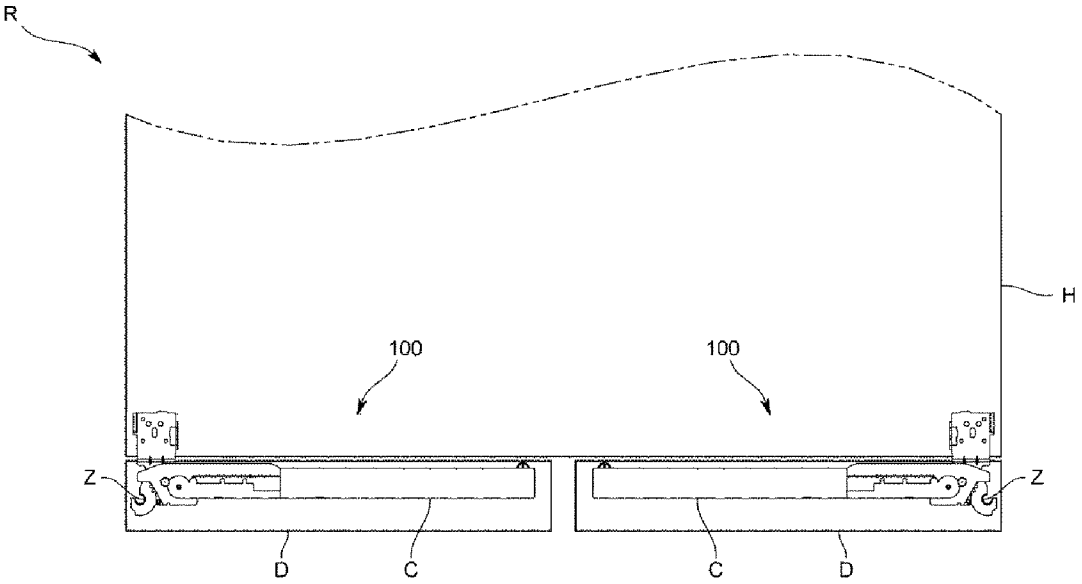
FIG. 1 is a schematic view showing an installation state of a door driving system for a refrigerator according to an embodiment.

As illustrated in FIG. 1, a refrigerator R to which a door driving system in accordance with an embodiment of the present disclosure is applied includes a housing H having an open front surface, and two doors D installed at left and right sides of the front of the housing H to open or close an opening of the housing H. The two doors D are rotatably supported by hinge Z, respectively.

Door driving systems 100 for use in a refrigerator are configured to individually open or close the two doors D of the refrigerator R, and installed to be respectively accommodated in casings C provided on the two doors D.

In the present embodiment, the door driving systems 100 for use in a refrigerator are bisymmetrical. Thus, the door driving system 100, for use in a refrigerator, which is configured to open or close the right door D will be described with reference to FIG. 1 below.

Figure 2:
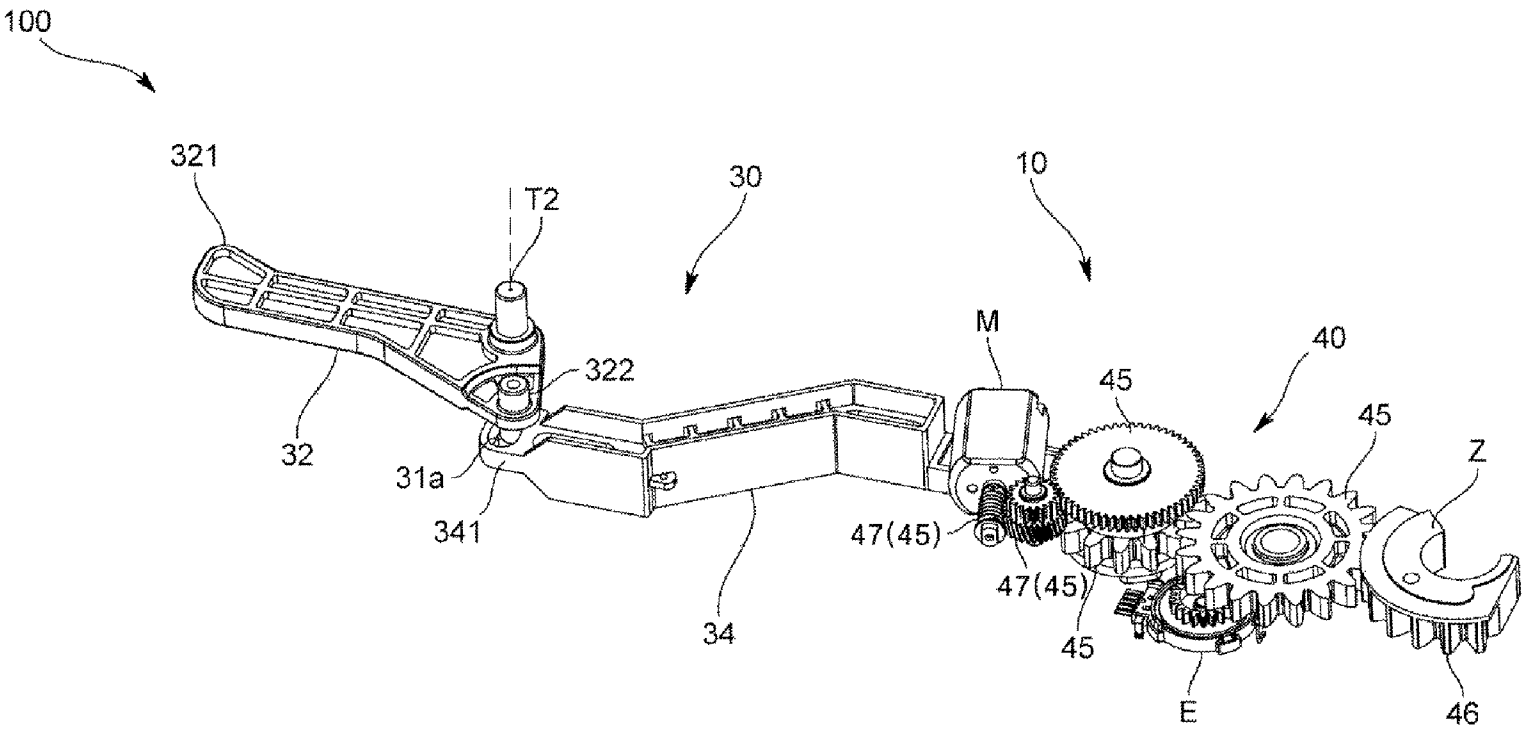
FIG. 2 is a perspective view of a door driving system for a refrigerator according to an embodiment.
Figure 3:
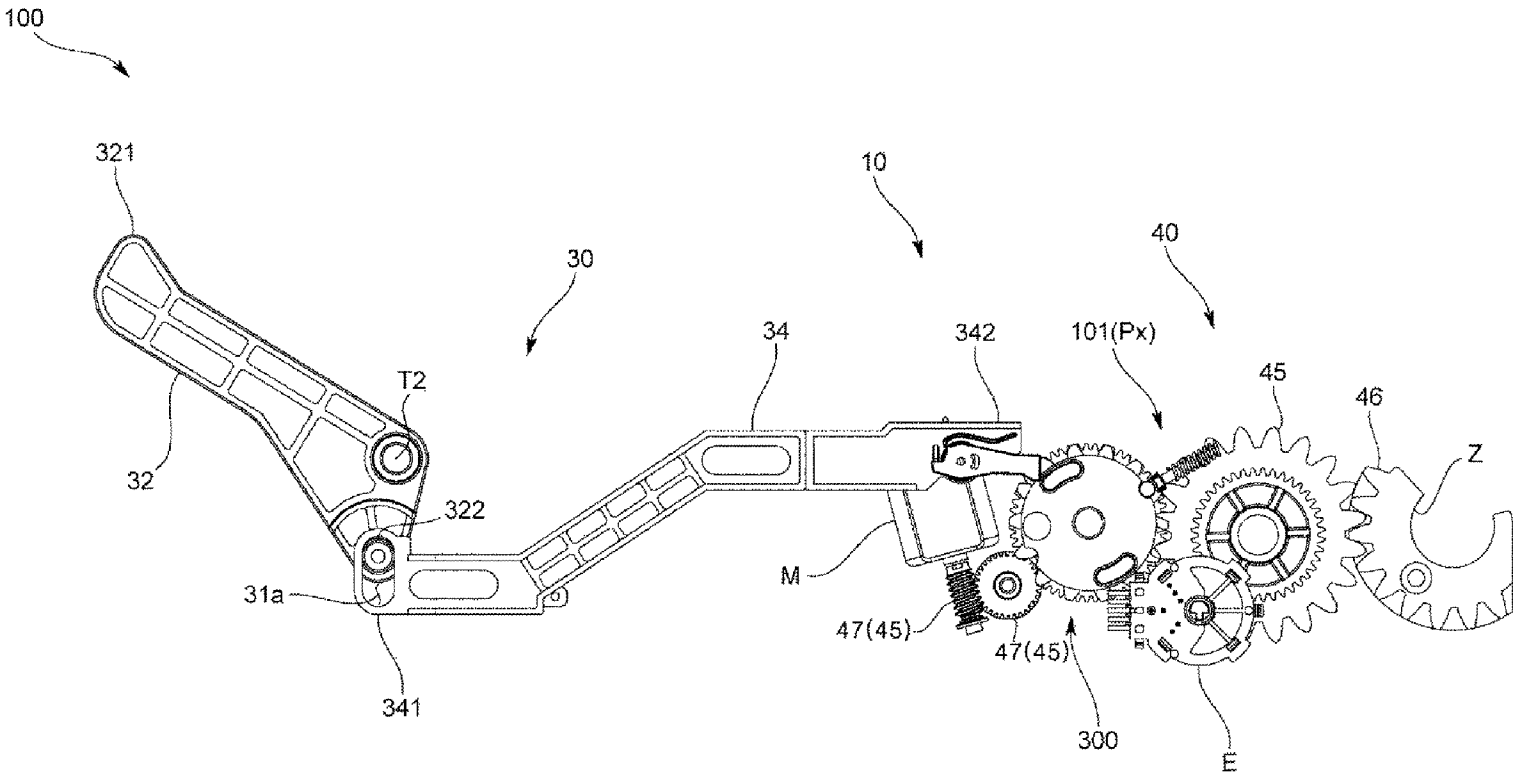
FIG. 3 is a plan view of a door driving system for a refrigerator according to an embodiment.
Figure 4:
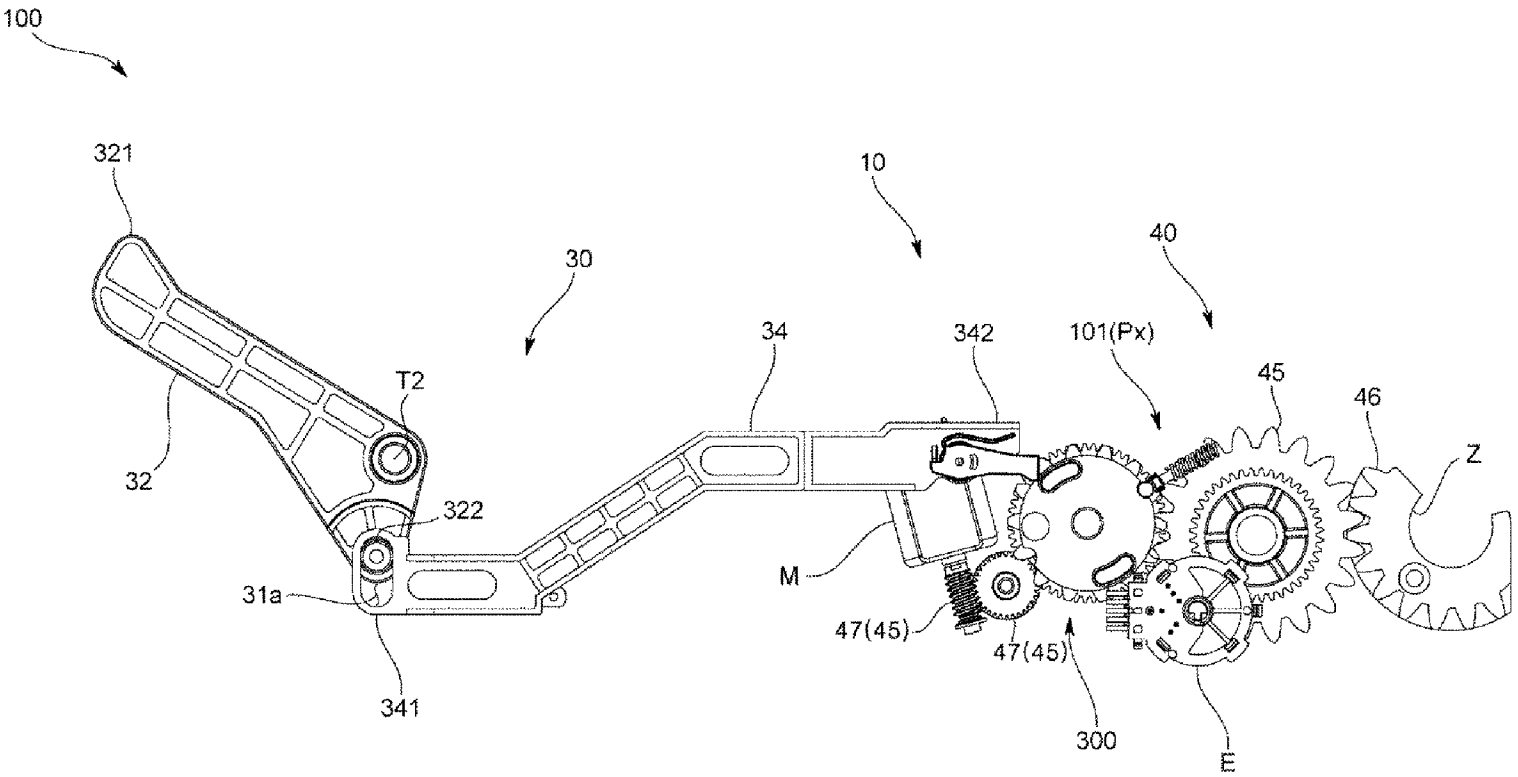
FIG. 4 is a plan view showing the operation of an auxiliary device in a door driving system for a refrigerator according to an embodiment.

As illustrated in FIGS. 2 to 4, the door driving system 100 for use in a refrigerator includes a driving device 10 which generates power for opening or closing the door D and transfers the power to the door D, and an auxiliary device 30 which assists in opening the door D which is at a closed position.

First, a structure of the driving device 10 will be described. As illustrated in FIGS. 2 to 4, the driving device 10 includes a motor M which generates power, and a power transfer device 40 which transfers the power generated by the motor M to the door D via the hinge Z.

The motor M is installed to be accommodated in the casing C on the door D. An output shaft of the motor M makes normal rotation or reverse rotation according to a control signal received from a controller (not shown).

In the present embodiment, the motor M is configured to open or close the door D according to a predetermined speed pattern on the basis of the control signal received from the controller. More specifically, the controller receives a position signal representing the position of the door D from an encoder E, and generates the control signal on the basis of the position signal.

The power transfer device 40 is arranged between the motor M and the hinge Z, includes a plurality of driving gears 45 rotated linked with the motor M and a missing-teeth gear 46 installed at the hinge Z, and is configured to transfer power of the motor M to the hinge of the door D only through rotation of the gears 45 and 46. Furthermore, in the present embodiment, one of the plurality of driving gears 45 may be a worm gear 47 (including a worm and a worm wheel) connected to the output shaft of the motor M.

The auxiliary device 30 applied to a door driving system for use in a refrigerator in accordance with an embodiment of the present disclosure will be described below.

The auxiliary device 30 generates auxiliary power for opening the door D. In the present embodiment, the auxiliary device 30 is installed to be accommodated in the casing C on the door D.

As illustrated in FIGS. 3 and 4, the auxiliary device 30 is installed to be slidable, and includes a slide member 34 which receives the power of the motor M and is slid by the power, and an auxiliary pressurizing member 32 which is rotatable around an axis of rotation T2 while being linked with sliding of the slide member 34. The auxiliary pressurizing member 32 comes in contact with the housing H while being rotated around the axis of rotation T2 to supply the auxiliary power to the door D.

The slide member 34 extends to be long and is configured to be slidable in a direction in which it extends. The auxiliary pressurizing member 32 is installed at one end part 341 of the slide member 34, and power is supplied to another end part 342 of the slide member 34 from the power transfer device 40.

The auxiliary pressurizing member 32 includes a passing-through member 322 installed to pass through a passing-through hole 31*a* formed in the end part 341 of the slide member 34. The auxiliary pressurizing member 32 may be installed in the slide member 34 by inserting the passing-through member 322 into the passing-through hole 31*a*.

The auxiliary pressurizing member 32 includes a collision part 321 which collides against the front surface of the housing H as the auxiliary pressurizing member 32 is rotated about the axis of rotation T2.

As illustrated in FIG. 4, due to the above structure, as the slide member 34 slides toward the end part 341 from the other end part 342, the auxiliary pressurizing member 32 is rotated about the axis of rotation T2. The passing-through member 322 may serve as a point of application of force and the collision part 321 serves as a point of action. Thus, the auxiliary power transferred via the collision part 321 acts on the door D. Accordingly, a magnetic force between the door D and the housing H may be overcome.

A clutch device 101 applied to a door driving system for use in a refrigerator in accordance with an embodiment of the present disclosure will be described below.

As illustrated in FIGS. 3 and 4, the door driving system 100 for use in a refrigerator in accordance with the present embodiment further includes the clutch device 101 configured to selectively transfer power of the motor M to the hinge Z. That is, the clutch device 101 causes either a power transfer state Px in which the power of the motor M is transferred to the hinge Z or a non-power transfer state Qx in which the power of the motor M is not transferred to the hinge Z to be performed.

When the clutch device 101 is switched to the non-power transfer state Qx and thus the power of the motor M is not transferred to the hinge Z, the auxiliary device 30 generates auxiliary power to move the door D, which is at the closed position, in an opening direction.

As illustrated in FIGS. 3 and 4, the clutch device 101 is interposed between the motor M and the hinge Z, and configured to receive power from the motor M and to be switched to the power transfer state Px or the non-power transfer state Qx only by the power of the motor M. In the present embodiment, a planetary gear unit 300 is used as the clutch device 101.

Figure 5:
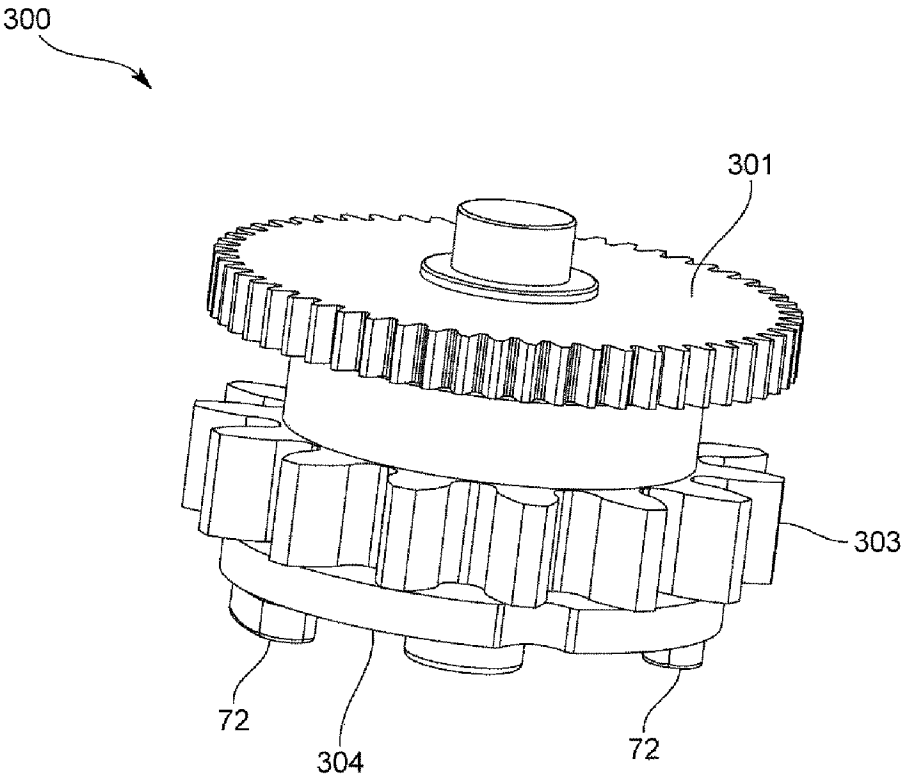
FIG. 5 is a perspective view of the configuration of the planetary gear unit according to the embodiment.
Figure 6:
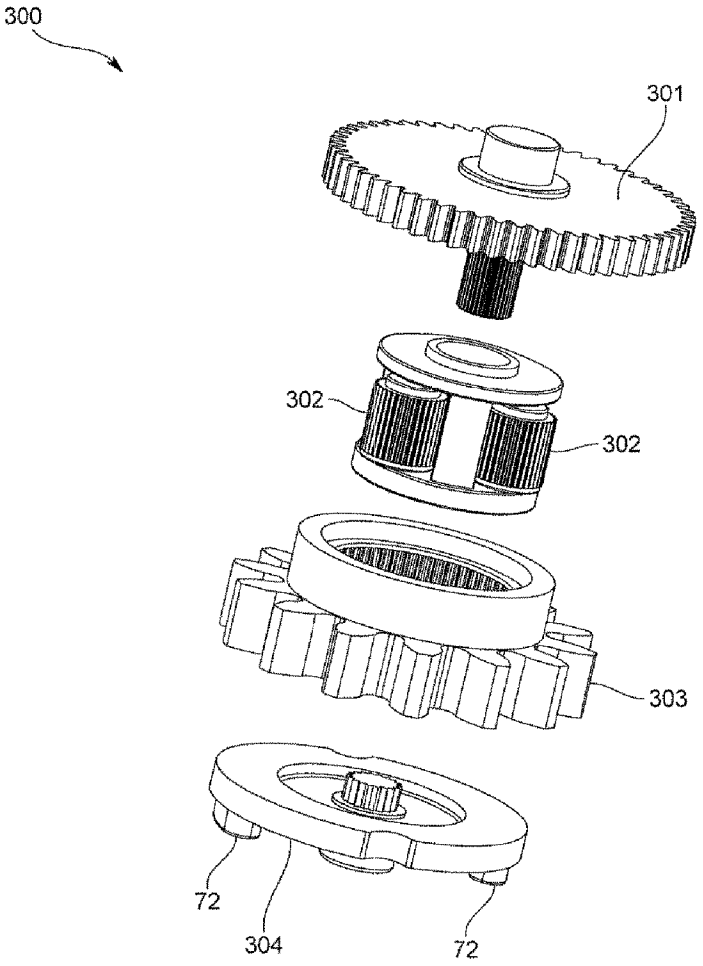
FIG. 6 is an exploded perspective view of the planetary gear unit according to one embodiment.

As illustrated in FIGS. 5 and 6, the planetary gear unit 300 includes a sun gear 301 rotated linked with the motor M, a plurality of planetary gears 302 having teeth engaged with those of the sun gear 301, an internal gear 303 having internal teeth engaged with the teeth of the plurality of planetary gears 302 and rotated linked with the door D, and a carrier 304 which supports the plurality of planetary gears 302 to be rotated on axes thereof. Here, the sun gear 301, the plurality of planetary gears 302, and the internal gear 303 are some of the plurality of driving gears 45 which will be described below.

Due to the above structure, when the sun gear 301 is rotated by power of the motor M, the plurality of planetary gears 302 are rotated on the axes thereof or revolve by the rotation of the sun gear 301. When the plurality of planetary gears 302 are rotated on the axes thereof, the internal gear 303 is rotated in a direction opposite to a direction of the rotation of the sun gear 301. When the plurality of planetary gears 302 revolve, the carrier 304 is rotated in the direction of the rotation of the sun gear 301.

More specifically, the carrier 304 is rotated linked with the rotation of the sun gear 301 in a state in which the internal gear 303 is fixed, and the internal gear 303 is rotated linked with the rotation of the sun gear 301 in a state in which the carrier 304 is fixed. That is, the power of the motor M applied to the sun gear 301 is output to the internal gear 303 or the carrier 304.

When one of the internal gear 303 and the carrier 304 is rotated in a state in which the sun gear 301 is fixed, the other is rotated since the sun gear 301 is fixed.

To explain the door driving system of the refrigerator differently, the refrigerator includes a planetary gear unit and at least one drive gear coupling the planetary gear to the motor, and the at least one drive gear and the planetary gear unit cooperate together to transfer the power output by the motor to the hinge to move the hinge and thereby open or close the door, without transferring a turning force generated by the hinge to the motor.

And at least one drive gear coupling the motor to the sun gear, when the hinge generates a turning force, the internal gear is rotated by the turning force with the at least one drive gear preventing the sun gear from rotating, which thereby causes the planetary gear to revolve, and thus the turning force is not transferred to the motor.

Figure 7A:
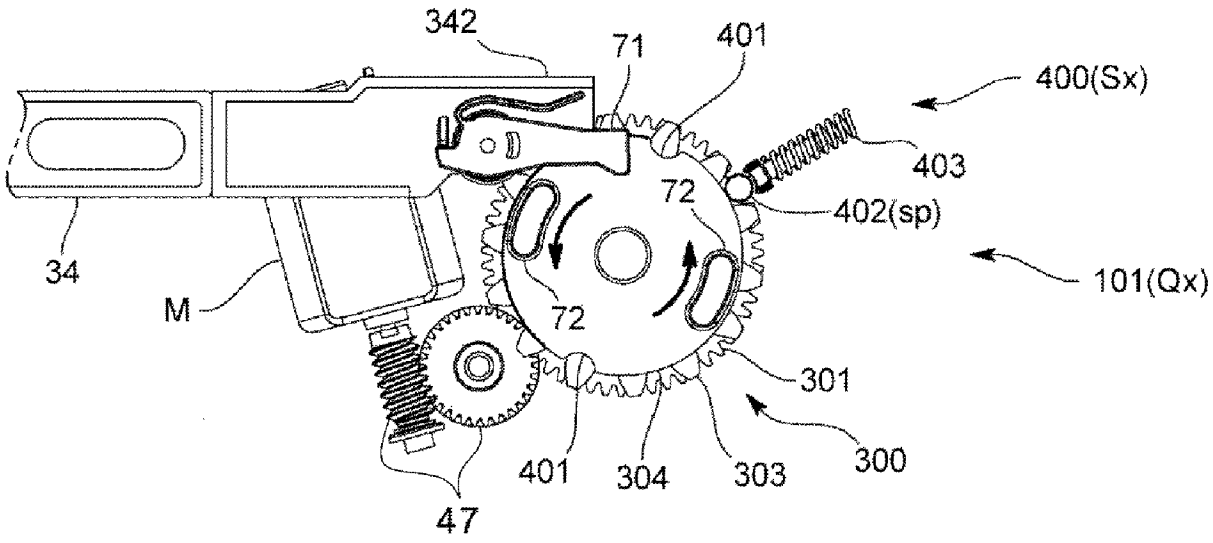
FIGS. 7A, 7B and 7C are plan views showing the operation of the clutch device in the refrigerator according to the embodiment.
Figure 7B:
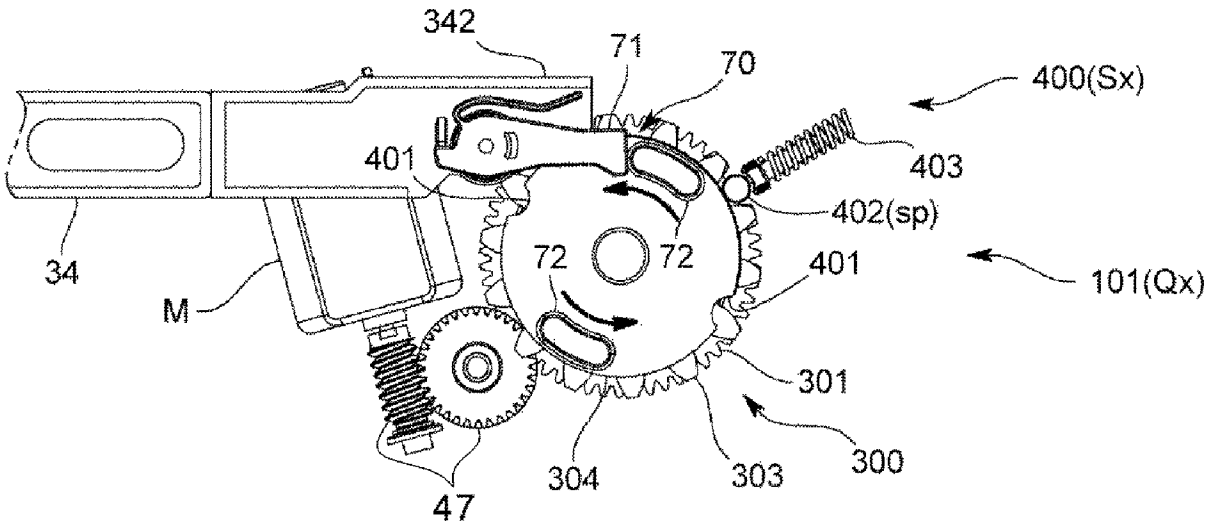
Figure 7C:
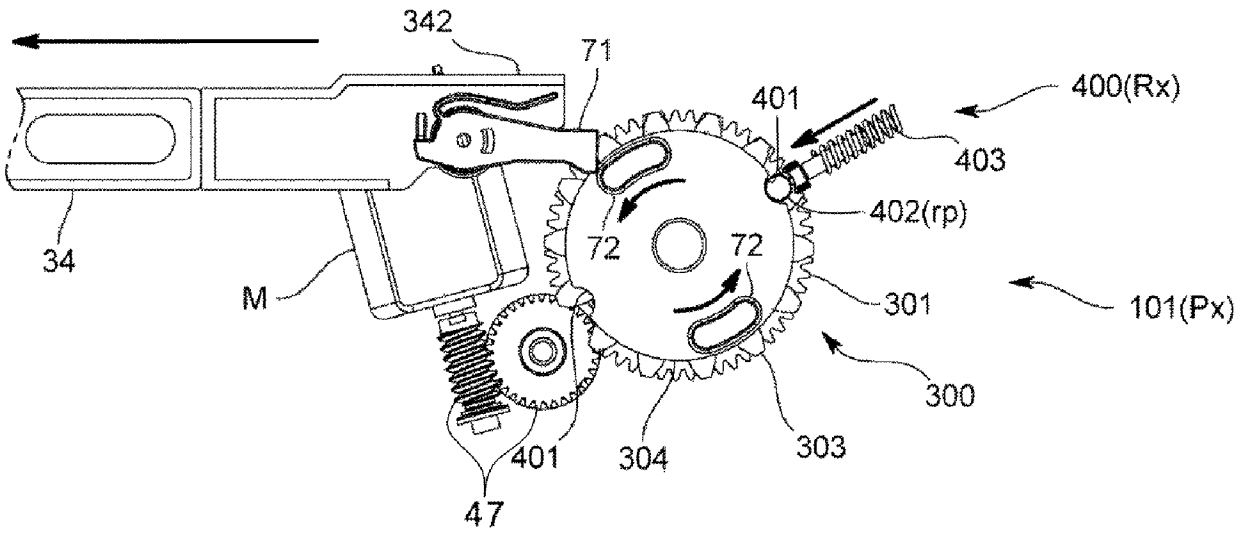

As illustrated in FIGS. 7A to 7C, the clutch device 101 in accordance with the present embodiment includes a locking device 400 which selectively limits rotation of the carrier 304. That is, the locking device 400 causes either a locked state Rx in which the carrier 304 is fixed not to rotate carrier 304 or an unlocked state Sx in which the carrier 304 is not fixed and thus the carrier 304 is rotatable to be performed.

More specifically, the locking device 400 includes dented parts 401 formed in an outer circumference surface of the carrier 304, a locking member 402 configured to be moved to advance or retreat between a locked position rp at which the locking member 402 is wedged in one of the dented parts 401 in the locked state Rx and a withdrawn position sp at which the locking member 402 is separated from the dented part 401 in the unlocked state Sx, and a pressurizing member 403 configured to pressurize the locking member 402 toward the locked position rp from the withdrawn position sp.

The dented parts 401 are provided on a plurality of points (two points in the present embodiment) on the outer circumference surface of the carrier 304 at regular intervals in a circumferential direction. In the present embodiment, the dented parts 401 are formed in an inwardly dented form in the outer circumference surface of the carrier 304.

As illustrated in FIG. 7C, when the carrier 304 is rotated to cause one of the dented parts 401 to reach a position corresponding to the locking member 402, the locking member 402 is wedged into the dented part 401 and is then in the locked position rp.

As illustrated in FIGS. 7A and 7B, when any one of the dented parts 401 is not at the position corresponding to the locking member 402, the locking member 402 is not wedged into any one of the dented parts 401. Thus, when the locking member 402 is in contact with a position on the outer circumference surface of the carrier 304 other than the dented parts 401, the locking member 402 is maintained at the withdrawn position sp.

That is, the rotation of the carrier 304 is not interfered with the locking member 402 when the locking member 402 is at the withdrawn position sp, and is limited by the locking member 402 when the locking member 402 is at the locked position rp. The locking member 402 in the present embodiment has a sphere shape but is not limited thereto.

The pressurizing member 403 is formed in the form of a spring having an elastic force or the like, and one end part thereof is fixed onto the casing C. The pressurizing member 403 in accordance with the present embodiment may apply an elastic force to the locking member 402 to overcome pressure applied by the pressurizing member 403 and to be moved from the locked position rp to the withdrawn position sp, when a force applied to the carrier 304 in a direction of rotation is greater than or equal to a predetermined level in a state in which the locking member 402 is at the locked position rp.

As described above, since the locking device 400 is provided, the carrier 304 is not rotated and the internal gear 303 is rotated in the locked state Rx in which the locking member 402 is at the locked position rp, and the internal gear 303 is not rotated and the carrier 304 is rotated in the unlocked state Sx in which the locking member 402 is at the withdrawn position sp.

In the present embodiment, as illustrated in FIG. 7B, a power conversion device 70 is arranged between the power transfer device 40 and the auxiliary device 30 to convert a force acting in a direction of rotation to be transferred by the power transfer device 40 into a force acting in a direction in which the slide member 34 of the auxiliary device 30 slides. More specifically, the power conversion device 70 is arranged between the slide member 34 and the carrier 304 to convert a force acting on the carrier 304 in the direction of rotation into the force acting in the direction in which the slide member 34 slides.

The power conversion device 70 in accordance with the present embodiment is a so-called latch mechanism, and includes rotation parts 72 (two rotation parts 72 in the present embodiment) installed on a bottom surface of the carrier 304 and rotated linked with the carrier 304, and a hook part 71 installed on the other end part 342 of the slide member 34 and selectively engaged with one of the rotation parts 72 according to a direction of rotation of the carrier 304.

More specifically, the carrier 304 is arranged adjacent to the other end part 342 of the slide member 34 and thus one of the rotation parts 72 rotated together with the carrier 304 pressurizes the hook part 71 when the carrier 304 is rotated in a forward direction due to normal rotation of the motor M. When one of the rotation parts 72 pressurizes the hook part 71, power acting in the direction of rotation of the carrier 304 is converted through the hook part 71 into power acting in the direction in which the slide member 34 slides and is then transferred to the slide member 34. Thus, the auxiliary pressurizing member 32 is rotated simultaneously with sliding of the slide member 34, the collision part 321 collides against the housing H, and then auxiliary power is applied to the door D. Accordingly, a magnetic force between the door D and the housing H may be overcome.

Furthermore, as described above, a latch mechanism is employed as the power conversion device 70 in accordance with the present embodiment. When the motor M makes reverse rotation to rotate the carrier 304 in a backward direction, the hook part 71 is away from a moving path of the rotation parts 72 and thus the rotation parts 72 are not coupled to the hook part 71. Accordingly, rotation of the carrier 304 is not interfered.

An operation of the door driving system 100 for use in a refrigerator in accordance with the present embodiment will be described below.

First, a case in which the door D which is at the closed position is moved in an opening direction will be described below.

First, when the motor M is driven by a control signal received from the controller, either the worm gear 47 which is an element of the driving gear 45 or the sun gear 301 is rotated. In this case, the locking member 402 is at the withdrawn position sp, the locking device 400 is in the unlocked state Sx, and the clutch device 101 is in the non-power transfer state Qx (see FIG. 7A).

In this state, when the sun gear 301 is rotated, the internal gear 303 is not rotated and the carrier 304 is rotated. Since the rotation parts 72 are rotated together with the carrier 304, one of the two rotation parts 72 comes in contact with the hook part 71 (see FIG. 7B). Thereafter, as the carrier 304 is continuously rotated, the rotation part 72 pressurizes the hook part 71. Thus, the slide member 34 slides and a magnetic force between the door D and the housing H may be overcome by auxiliary power.

After the magnetic force between the door D and the housing H is overcome, when the carrier 304 is continuously rotated and thus one of the dented parts 401 in the outer circumference surface of the carrier 304 reaches a position corresponding to the pressurizing member 403, the locking member 402 is wedged into one of the dented parts 401 due to pressure applied by the pressurizing member 403 and is thus moved from the withdrawn position sp to the locked position rp. Thus, the locking device 400 is switched from the unlocked state Sx to the locked state Rx and the clutch device 101 is switched from the non-power transfer state Qx to the power transfer state Px (see FIG. 7C).

When the locking device 400 is switched to the locked state Rx, the carrier 304 cannot be rotated. Thus, the carrier 304 is not rotated and the internal gear 303 is rotated by the rotation of the sun gear 301. Thus, the power of the motor M transferred to the sun gear 301 is output through the internal gear 303 and is then transferred to the hinge Z of the door D through the driving gears 45 or the missing-teeth gear 46 between the internal gear 303 and the hinge Z of the door D, thereby moving the door D in the opening direction.

Next, a case in which the door D which is in the opened state is moved in a closing direction will be described below.

First, when the motor M is driven by a control signal received from the controller, either the worm gear 47 which is an element of the driving gear 45 or the sun gear 301 is rotated. In this case, the locking member 402 is at the locked position rp, the locking device 400 is in the locked state Rx, and the clutch device 101 is in the non-power transfer state Qx (FIG. 7C).

In this state, the power of the motor M is transferred to the hinge Z of the door D through the driving gear 45 or the missing-teeth gear 46. Thus, the door D is moved in the closing direction and is finally moved to the closed position due to a magnetic force between the door D and the housing H. Since the internal gear 303 is locked in a state in which the door D is at the closed position, rotation of the sun gear 301 is transferred to the carrier 304. Furthermore, when the motor M is further instantaneously driven in the closing direction right after the door D is closed, the locking member 402 may overcome pressure applied by the pressurizing member 403 and thus be moved from the locked position rp to the withdrawn position sp. At the same time, the locking device 400 is switched from the locked state Rx to the unlocked state Sx.

Next, a case in which the door D is moved in the opening direction or the closing direction, i.e., a user tries to move the door D in a backward direction will be described below. In this case, the internal gear 303 is rotated in the backward direction while being linked with the door D, but the sun gear 301 is not rotated since the worm gear 47 is coupled to the output shaft of the motor M. Thus, the rotation of the internal gear 303 is transferred to the carrier 304, and the locking member 402 wedged into one of the dented parts 401 is moved from the locked position rp to the withdrawn position sp when a force which is greater than or equal to a predetermined level is applied to the carrier 304. Thus, the locking device 400 is switched from the locked state Rx to the unlocked state Sx and the clutch device 101 is switched from the power transfer state Px to the non-power transfer state Qx. Thus, the force applied to the door D by the user to move the door D in the backward direction is not transferred to the motor M. Accordingly, the motor M or these gears are prevented from being damaged.

Next, a case in which the door D is manually opened or closed will be described below.

When the door which is at the closed position is manually opened or closed, rotation of the internal gear 303 linked with the door D is transferred to the carrier 304 since the worm gear 47 is coupled to the output shaft of the motor M. In this case, the locking device 400 is in the unlocked state Sx, the clutch device 101 is in the non-power transfer state Qx, and thus the force applied to the door D by the user to move the door D is not transferred to the motor M. Accordingly, the user may easily move the door D.

In the door driving system 100 having the above structure for use in a refrigerator, the clutch device 101 is in the non-power transfer state Qx when the auxiliary device 30 generates auxiliary power and thus a magnetic force between the door D and the housing H in a state in which power of the motor M is not transferred to the hinge Z may be overcome. Thus, a torque needed to overcome the magnetic force between the door D and the housing H may be reduced.

Furthermore, the door driving system 100 for use in a refrigerator includes the planetary gear unit 300 serving as a speed reducer and may thus reduce the speed of rotation of the motor M through the gears of the planetary gear unit 300. Therefore, the number of spur gears to be arranged in a direction of a plane to reduce the speed of the rotation of the motor M may be reduced and thus the door driving system 100 for use in a refrigerator may be manufactured to be compact.

However, the present disclosure is not limited to the above embodiment.

In the present embodiment, when a force which is greater than or equal to a predetermined level is applied to a carrier, an elastic force of a pressurizing member is appropriately determined to move a locking member from a locked position to a withdrawn position but embodiments of the present disclosure are not limited thereto. Alternatively, the locking member may be moved using a torque limiter from the locked position to the withdrawn position.

In the present embodiment, two rotation parts are arranged on a rear surface of the carrier but embodiments of the present disclosure are not limited thereto. Alternatively, one or three or more rotation parts may be arranged on the rear surface of the carrier.

Furthermore, in the present embodiment, a missing-teeth gear having teeth only in some arch-shaped sections thereof is installed at a hinge but embodiments of the present disclosure are not limited thereto. Alternatively, a gear having teeth in entire round sections thereof may be installed at the hinge.

In addition, a door driving system for use in a refrigerator has been described above in the present embodiment but embodiments of the present disclosure are not limited thereto. The door driving system according to the present disclosure is applicable to various devices as well as refrigerators.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a hinge;

a door that rotates via the hinge to open and close; and a door driving system comprising:

a motor to output power, a sun gear linked with the motor, a planetary gear linked with the sun gear, an internal gear linked with the planetary gear and configured to transfer the power output by the motor to the hinge, a carrier, and a locking device to selectively put the carrier in an unlocked state in which the carrier is rotatable, and in a locked state in which rotation of the carrier is limited, wherein the sun gear, the planetary gear, the internal gear, the carrier and the locking device cooperate together so that when the sun gear is rotated by the power output by the motor with the carrier in the locked state, the rotation of the sun gear causes the planetary gear rotates to rotate about a rotation axis to transfer the power output by the motor to the internal gear to thereby move the hinge to automatically open or close the door, and when the sun gear is rotated by the power output by the motor with the carrier in the unlocked state, the rotation of the sun gear causes the planetary gear to revolve to transfer the power output by the motor to the carrier.

2. The refrigerator according to claim 1, wherein the sun gear, the planetary gear, the internal gear and the carrier cooperate together so that, when the planetary gear revolves to transfer the power output by the motor to the carrier, the power output by the motor is not transferred to the internal gear.

3. The refrigerator according to claim 1, wherein the internal gear comprises internal teeth engaged with teeth of the planetary gear, and is rotated by the internal teeth when the planetary gear is rotated about the rotation axis to transfer the power output by the motor to the internal gear.

4. The refrigerator according to claim 1, wherein the carrier is engaged with teeth of the planetary gear and is rotatable, and the planetary gear revolves when the carrier is rotated.

5. The refrigerator according to claim 1, wherein the carrier comprises a dented part formed in an outer circumference surface thereof, and the locking device comprises:

a locking member to be selectively wedged into the dented part as the carrier is rotated, to thereby put the carrier in the locked state, and a pressurizing member to pressurize the locking member against an outer surface of the carrier.

6. The refrigerator according to claim 1, when the internal gear is rotated by a turning force generated in the hinge, the planetary gear revolves and does not transmit the turning force to the motor.

7. The refrigerator according to claim 1, wherein the carrier has a rotatable state in which the carrier is rotatable when the power of the motor is transferred to the carrier, the refrigerator further comprising:

an auxiliary device comprising:

a slide member which is slidable, a power conversion device coupled to an end part of the slide member and configured to cause the slide member to slide as the carrier is rotated from the power of the motor being transferred to the carrier with the carrier being in the rotatable state, and an auxiliary pressurizing member coupled to another end part of the slide member and, with the door being closed, rotate, linked with the sliding of the slide member, to pressurize the door, to thereby move the door in an opening direction.

8. The refrigerator according to claim 7, wherein:

the carrier comprises a rotation part arranged above the carrier and rotated together with the carrier, and the power conversion device comprises a hook part to be selectively engaged with the rotation part according to a direction of rotation of the carrier.

9. A refrigerator comprising:

a hinge;

a door that opens and closes via the hinge;

a motor to output power;

a planetary gear unit comprising a sun gear, a plurality of planetary gears having teeth engaged with teeth of the sun gear, an internal gear having internal teeth engaged with the teeth of the plurality of planetary gears, and being linked with the door, and a carrier supporting the plurality of planetary gears to be rotatable on rotation axes, respectively; and at least one drive gear coupling the planetary gear to the motor, wherein the sun gear, the plurality of planetary gears, the internal gear and the carrier cooperate together so that the power output by the motor is transferred to the hinge via the sun gear, the plurality of planetary gears, and the internal gear, to transfer the power output by the motor to the hinge to move the hinge and thereby open or close the door, and a turning force generated by the hinge is transferred to the carrier via the internal gear and the plurality of planetary gears, without transferring the turning force generated by the hinge to the motor.

10. The refrigerator according to claim 9, further comprising:

a locking device switchable between a locked state and an unlocked state, wherein the carrier is fixed in the locked state and is rotatable in the unlocked state, wherein the carrier comprises a dented part formed in an outer circumference surface thereof, and the locking device comprises:

a locking member movable between a locked position and a withdrawn position, wherein the locking member is wedged into the dented part at the locked position in the locked state and is separated from the dented part at the withdrawn position in the unlocked state, and a pressurizing member to pressurize the locking member toward the locked position from the withdrawn position.

11. The refrigerator according to claim 10, wherein the locking member is provided to overcome pressure applied by the pressurizing member and to be moved from the locked position to the withdrawn position when the turning force generated by the hinge applied to the carrier is greater than or equal to a predetermined level in a state in which the locking member is in the locked position.

12. The refrigerator according to claim 10, wherein the planetary gear unit is provided to rotate the carrier in the unlocked state by sequentially transferring the power output by the motor to the sun gear, the plurality of planetary gears, and the carrier, and to transfer the power output by the motor to the hinge in the locked state by sequentially transferring the power output by the motor to the sun gear, the plurality of planetary gears, and the internal gear.

13. The refrigerator according to claim 10, wherein, when the turning force is generated by the hinge, the planetary gear unit is provided to sequentially transfer the turning force to the internal gear, the plurality of planetary gears, and the carrier and not to transfer the turning force to the sun gear.

14. The refrigerator according to claim 10, further comprising:

an auxiliary device to generate auxiliary power from the power output by the motor, for moving the door from being closed to being opened, wherein the auxiliary power is generated by the auxiliary device before the power output by the motor is transferred to the hinge.

15. The refrigerator according to claim 14, wherein, in the unlocked state, the power output by the motor is transferred to the auxiliary device via the carrier, the door which is closed is moved in an opening direction by the auxiliary power generated by the auxiliary device, and then the locking device is switched from the unlocked state to the locked state, thereby transferring the power to the hinge through the internal gear.

16. A refrigerator comprising:

a door;

a hinge connected to the door;

a motor;

at least one driving gear;

a sun gear engaged with the motor via the driving gear;

a planetary gear engaged with the sun gear;

an internal gear engaged with the planetary gear and configured to transfer power generated by the motor to the hinge to move the hinge and thereby open or close the door; and a carrier having a locked state in which the carrier does not rotate and an unlocked state is which the carrier is rotatable, wherein the sun gear, the planetary gear, the internal gear and the carrier cooperate together so that when the sun gear is rotated by power of the motor with the carrier in the locked state, the rotation of the sun gear causes the planetary gear to rotate about a rotation axis, which causes the internal gear to rotate in a direction opposite to a direction of rotation of the sun gear, to thereby output the power of the motor to the internal gear to move the hinge, when the sun gear is rotated by power of the motor with the carrier the unlocked state, the rotation of the sun gear causes the planetary gear to revolve, without rotation of the internal gear, which causes the carrier to rotate in the direction of rotation of the sun gear, so that the power of the motor is thereby output to the carrier and not transferred to the internal gear, and when the hinge generates a turning force with the carrier in the locked state, the internal gear is rotated by the turning force, with the at least one driving gear preventing the sun gear from rotating, to cause the planetary gear to revolve, which causes the turning force to be transferred to the carrier and not to the motor, and, when the turning force transferred to the carrier causes a force greater than or equal to a specific level to be applied to the carrier, the carrier moves from the locked state to the unlocked state to cause the carrier to rotate.

17. A refrigerator according to claim 16, further comprising:

an auxiliary device configured to, when the door is closed and the carrier rotates, move with rotation of the carrier to pressurize the door, and thereby provide an auxiliary force to assist in opening the door.

* * * * *